US008944853B2

(12) United States Patent
Liao et al.

(10) Patent No.: US 8,944,853 B2
(45) Date of Patent: Feb. 3, 2015

(54) RETRACTABLE UNIVERSAL SERIAL BUS CONNECTOR AND RETRACTABLE CONNECTOR

(71) Applicants: Sheng-Hsin Liao, New Taipei (TW); Wen-Fu Liao, New Taipei (TW)

(72) Inventors: Sheng-Hsin Liao, New Taipei (TW); Wen-Fu Liao, New Taipei (TW)

( * ) Notice: Subject to any disclaimer, the term of this patent is extended or adjusted under 35 U.S.C. 154(b) by 134 days.

(21) Appl. No.: 13/692,361

(22) Filed: Dec. 3, 2012

(65) Prior Publication Data

US 2014/0057495 A1 Feb. 27, 2014

(30) Foreign Application Priority Data

Aug. 22, 2012 (TW) ..... 101130394 A

(51) Int. Cl.

| | |
|---|---|
| ***H01R 24/00*** | (2011.01) |
| ***H01R 13/46*** | (2006.01) |
| ***H01R 13/453*** | (2006.01) |
| ***H01R 13/71*** | (2006.01) |
| ***H01R 27/02*** | (2006.01) |
| ***H01R 35/04*** | (2006.01) |
| *H01R 31/06* | (2006.01) |

(52) U.S. Cl.

CPC ..... *H01R 13/46* (2013.01); *H01R 13/4538* (2013.01); *H01R 13/71* (2013.01); *H01R 27/02* (2013.01); *H01R 35/04* (2013.01); *H01R 31/065* (2013.01)

USPC ..... 439/660

(58) Field of Classification Search

USPC ..... 439/660, 131, 166, 170–172, 626, 712

See application file for complete search history.

(56) References Cited

U.S. PATENT DOCUMENTS 8,029,303 B2 * 10/2011 Chiang ..... 439/172

* cited by examiner

*Primary Examiner* — Vanessa Girardi

(74) *Attorney, Agent, or Firm* — Li & Cai Intellectual Property (USA) Office

(57) ABSTRACT

A retractable USB connector includes a first module and a second module. The first module has a first insulating main body and a first conductive module formed with a plurality of first conductive terminals and a plurality of a second conductive terminals. The second module has a second insulating main body and a second conductive module. The second module is linearly movable along the first module. When the second module contacts the first and second conductive terminals, electrical connection is established. In contrast, when the second module is removed from the first and second conductive terminals, electrical connection is terminated as well.

21 Claims, 13 Drawing Sheets

RETRACTABLE UNIVERSAL SERIAL BUS CONNECTOR AND RETRACTABLE CONNECTOR

BACKGROUND

1. Field of the Invention

The instant disclosure relates to an electronic connector; in particular, to a retractable universal serial bus (USB) connector and a retractable connector.

2. Description of Related Art

Universal serial bus (USB) is widely used in a great variety of electronic products. At least one or more USB connectors can be seen on a single electronic device. For example, Mini USB and Micro USB have smaller dimensions therefore usually being utilized in portable devices.

However, the conventional connectors have only one type of USB module thereon. In other words, a USB connector is only compatible to any one of the following standards: USB A, USB B, Mini USB, Micro USB and the like. The USB connector is exclusive to one type of USB module resulting to limited application.

SUMMARY OF THE INVENTION

The object of the instant disclosure is to provide a retractable universal serial bus (USB) connector and a retractable connector compatible to different types of plugs thus supporting broader applications.

According to one exemplary embodiment of the instant disclosure, the retractable USB connector comprises a first module and a second module. The first module includes a first insulating main body and a first conductive module disposed therein. The first conductive module has a plurality of first conductive terminals and a plurality of second conductive terminals. The first conductive terminals are formed with a first contact portion and a first mounting terminal. Likewise, the second conductive terminals are formed with a second contact portion and a second mounting terminal. The second module includes a second insulating main body and a second conductive module disposed therein. The second conductive module has a plurality of third conductive terminals and a plurality of fourth conductive terminals. The third conductive terminals are formed with a third contact portion and a first conductive portion. Identically, the fourth conductive terminals are formed with a fourth contact portion and a second conductive portion. The second module is forwardly and backwardly movable along the first module. When the second module moves toward the second contact portion, the first and second conductive portions of the second module contact the corresponding first and second contact portions of the first module. Hence, the second conductive module is electrically contactable to the first conductive module. In contrast, when the second module moves away from the second contact portion, the first and second conductive portions of the second module are removed from the first and second contact portions of the first module so the first and second conductive modules are electrically disconnected.

The instant disclosure also provides another retractable USB connector, which comprises a first module and a second module. The first module includes a first insulating main body and a first conductive module disposed therein. The first conductive module has a plurality of first conductive terminals, each of which is formed with a first contact portion and a plurality of first mounting terminals. The second module includes a second insulating main body and a second conductive module disposed therein. The second conductive module has a plurality of third conductive terminals, each of which is formed with a third contact portion and a first conductive portion. The second module is forwardly and backwardly movable on the first module. When the second module moves toward the first contact portion, the first conductive portion of the second module contacts the corresponding first contact portion of the first module. Hence, the second conductive module is electrically contactable to the first conductive module. In contrast, when the second module moves away from the first contact portion, the first conductive portion of the second module is removed there-from as well so the first and second conductive modules are electrically disconnected.

The instant disclosure further provides another retractable connector, which comprises a first module and a second module. The first module includes a first insulating main body and a first conductive module disposed therein. The first conductive module has a plurality of first conductive terminals. The first conductive terminals are formed with a first contact portion and a plurality of first mounting terminals. Similarly, the second module includes a second insulating main body and a second conductive module disposed therein. The second conductive module has a plurality of third conductive terminals, each of which is formed with a third contact portion and a first conductive portion. The second module is forwardly and backwardly movable on the first module. When the second module moves toward the first contact portion, the first conductive portion of the second module contacts the corresponding first contact portion of the first module. Hence, the second conductive module is electrically contactable to the first conductive module. In contrast, when the second module moves away from the first contact portion, the first conductive portion of the second module is removed from the first contact portion of the first module so the first and second conductive modules are electrically disconnected.

The retractable structure can be adapted for different connector standards. In other words, for desired requirement, the connector can be structurally altered and satisfy the need accordingly. Thus the connector is capable to receive a better variety of electronic devices.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE PREFERRED EMBODIMENTS

Figure 1:
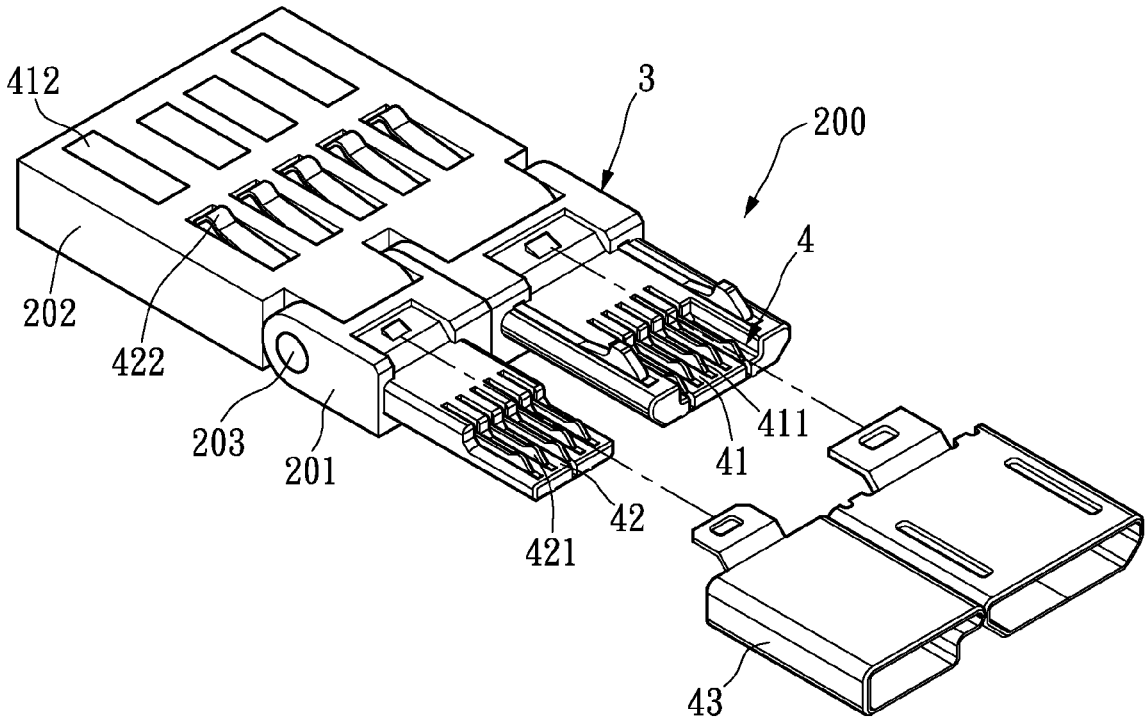
FIG. 1 illustrates an exploded view of a second module of a USB connector in accordance with a first embodiment of the instant disclosure.
Figure 2:
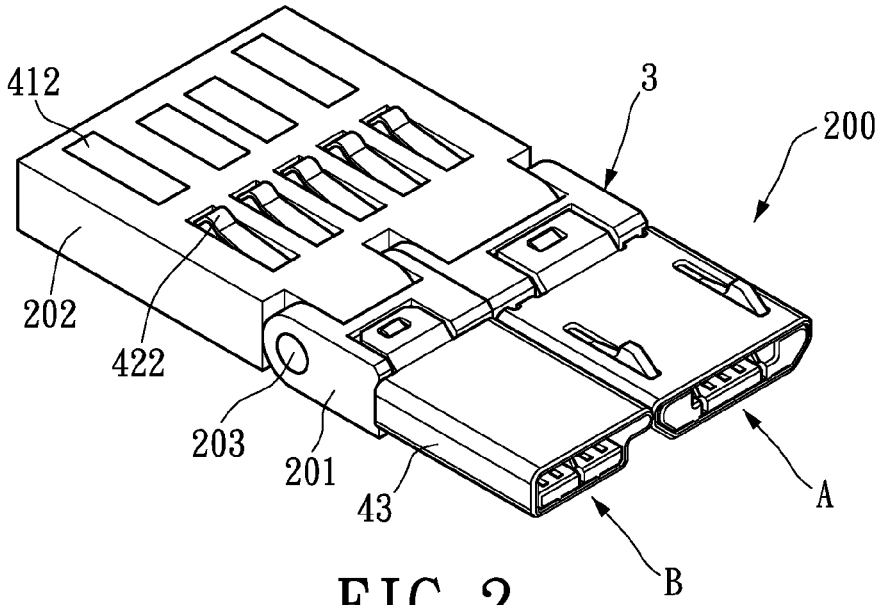
FIG. 2 illustrates a perspective view of a second module of a USB connector in accordance with a first embodiment of the instant disclosure.
Figure 3:
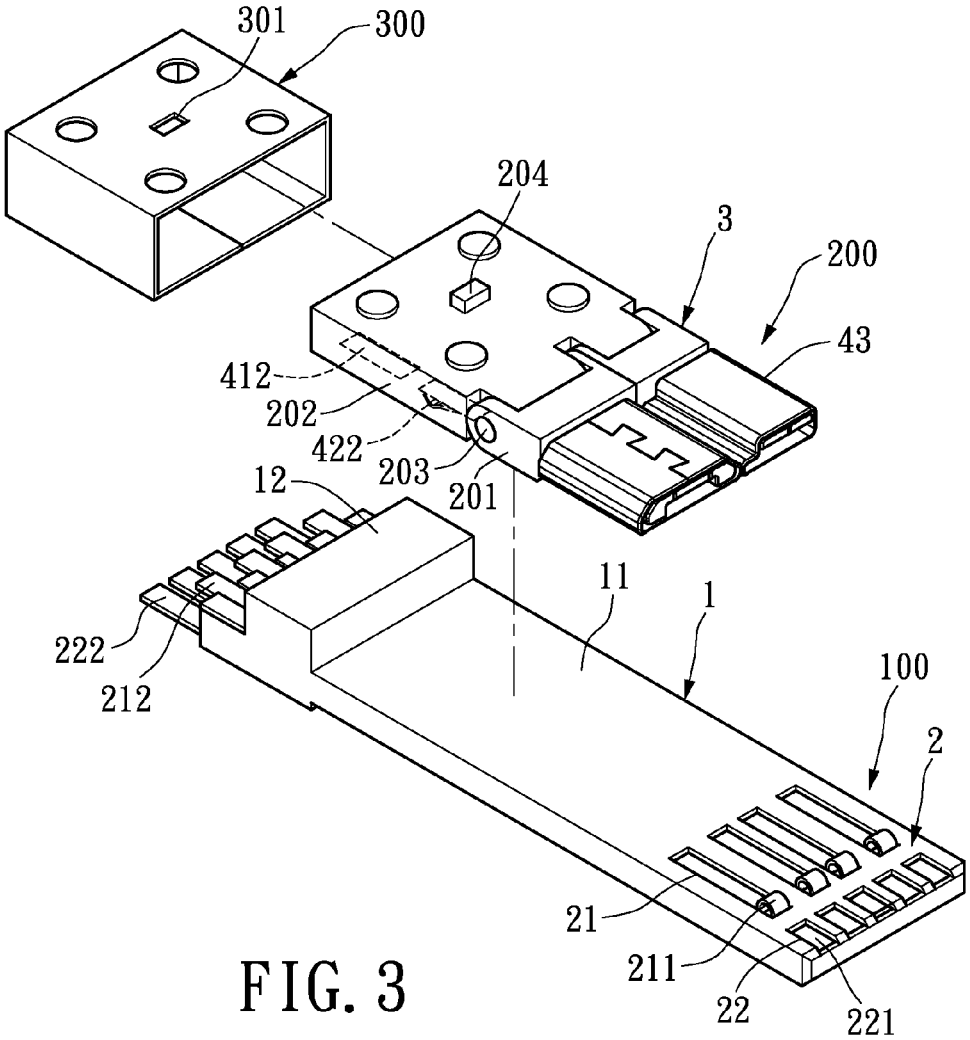
FIG. 3 illustrates an exploded view of a USB connector in accordance with a first embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings.

[First Embodiment]

With reference to FIGS. 1~4 the instant disclosure provides a retractable USB connector, which comprises a first module 100 and a second module 200. In the first embodiment, the first module 100 meets the USB 3.0 A (receptacle) specification, while the second module 200 meets the Micro USB (USB 3.0 Micro B plug) specification. However, the specifications of the first and second modules 100, 200 are not limited thereto. The first and second modules 100, 200 can be any one of the following standards: USB A, USB B, Micro USB and Mini USB. In addition, USB 3.0 and USB 2.0 are also adaptable to the first and second modules 100, 200. The first and second modules 100, 200 are interchangeable between receptacles and plugs.

The first module 100 includes a first insulating main body 1 and a first conductive module 2 which is disposed in the first insulating main body 1 to form the first module 100. In the first embodiment, the first conductive module 2 has a plurality of first conductive terminals 21 and a plurality of second conductive terminals 22. The first conductive terminals 21 are arranged on the first insulating main body 1 to execute USB 2.0 communication protocol. The second conductive terminals 22 are arranged on the first insulating main body 1 as well and working with the first conductive terminals 21 to execute USB 3.0 communication protocol. The second conductive terminals 22 may further have two pairs of high speed terminals and a ground terminal to perform high speed communication.

The heads of the first and second conductive terminals 21, 22 are formed with a first contact portion 211 and a second contact portion 221 respectively. The first and second contact portions 211, 221 are exposed to the exterior via the first insulating main body 1 and aligned in two rows to electrically connect the terminals of a corresponding electronic device. In addition, the tails of the first and second conductive terminals 21, 22 are formed with a plurality of first mounting terminals 212 and a plurality of second mounting terminals 222 respectively. The first and second mounting terminals 212, 222 extend beyond the first insulating main body 1 for electrically connecting to cables or circuits there-from and the connections thereof are not restricted thereto.

The first insulating main body 1 further includes a plate 11 and a bump 12 projecting out from the rear end of the plate 11. The first and second contact portions 211, 221 are arranged and exposed from the front end of the plate 11, whereas the first and second mounting portions 212, 222 protrude from the rear end thereof.

The second module 200 includes a second insulating main body 3 and a second conductive module 4 which is disposed in the second insulating main body 3 to form the second module 200. In the first embodiment, the second conductive module 4 has a plurality of third conductive terminals 41 and a plurality of fourth conductive terminals 42. The third conductive terminals 41 are arranged on the second insulating main body 3 to execute USB 2.0 communication protocol. The fourth conductive terminals 42 are arranged on the second insulating main body 3 as well and working with the third conductive terminals 41 to execute USB 3.0 communication protocol. The fourth conductive terminals 42 may further have two pairs of high speed terminals and a ground terminal to perform high speed communication.

The third and fourth conductive terminals 41, 42 are formed with a third contact portion 411 and a fourth contact portion 421 respectively at the front end thereof. The third and fourth contact portions 411, 421 are exposed to the exterior from the second insulating main body 3 and aligned in one row for electrically connecting an electronic product. At the tail end of the third and fourth conductive terminals 41, 42, a first conductive portion 412 and a second conductive portion 422 are formed. The first and the second conductive portions 412, 422 are exposed from the second insulating main body 3 to selectively contact the first and second contact portions 211, 221. Once the first and second contact portions 211, 221 and the first and second conductive portions 412, 422 contact, the first and second conductive modules 1, 4 are electrically connected. The second insulating main body 3 and the second conductive module 4 may further be enveloped by a metallic shell 43.

In the first embodiment, the first conductive module 2 includes the first and second conductive terminals 21, 22 arranged in two rows, while the second conductive module 4 includes the third and fourth conductive terminals 41, 42 arranged in one row. However, the number and layout of the conductive terminals are not restricted thereto.

Figure 5:
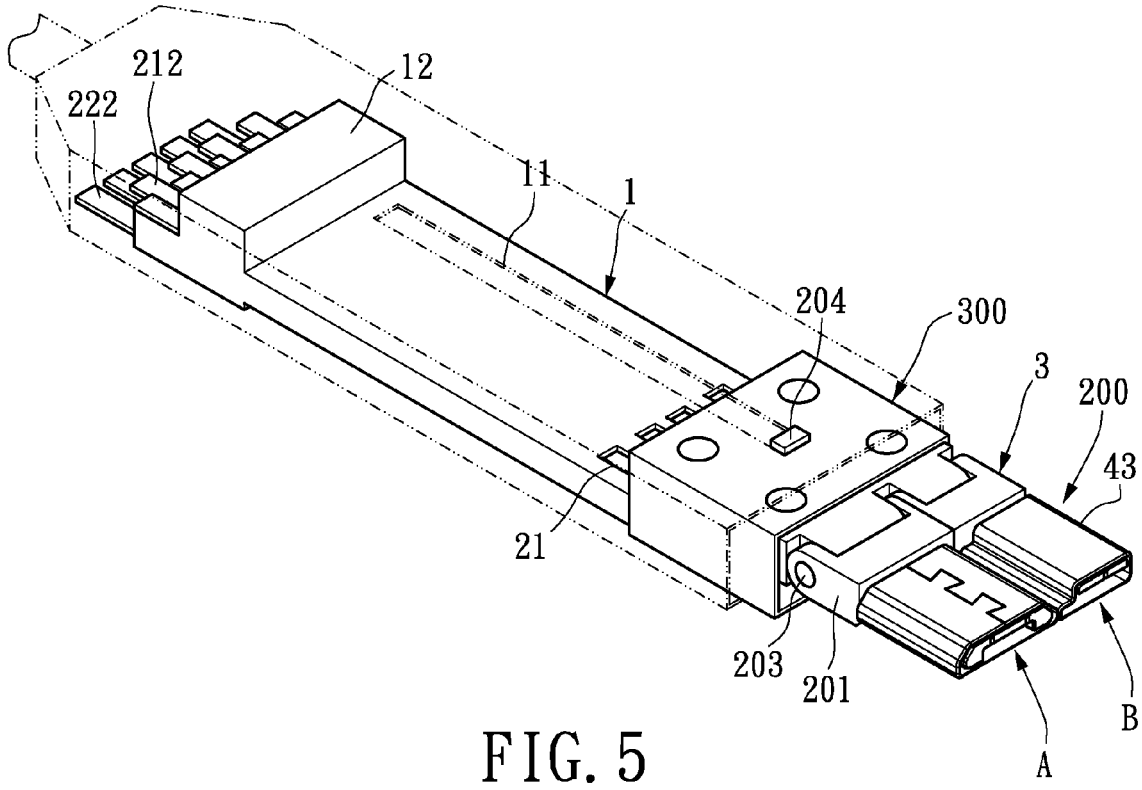
FIG. 5 illustrates a schematic diagram of a USB connector in use in accordance with a first embodiment of the instant disclosure.

The second module 200 is forwardly and backwardly movable along the first module 100. That is to say, the second module 200 is allowed for linear movement along the plate 11. When the second module 200 moves toward the first contact portion 211 (as shown in FIG. 5), the first and second conductive portions 412, 422 contacts the corresponding first and second contact portions 211, 221 resulting in electrical connection between the first and second conductive modules 2, 4. In other words, the second conductive module 4 receives power or signals from the associated cables or circuit connecting to the first conductive module 2 and therefore the second module 200 is live as well.

Figure 4:
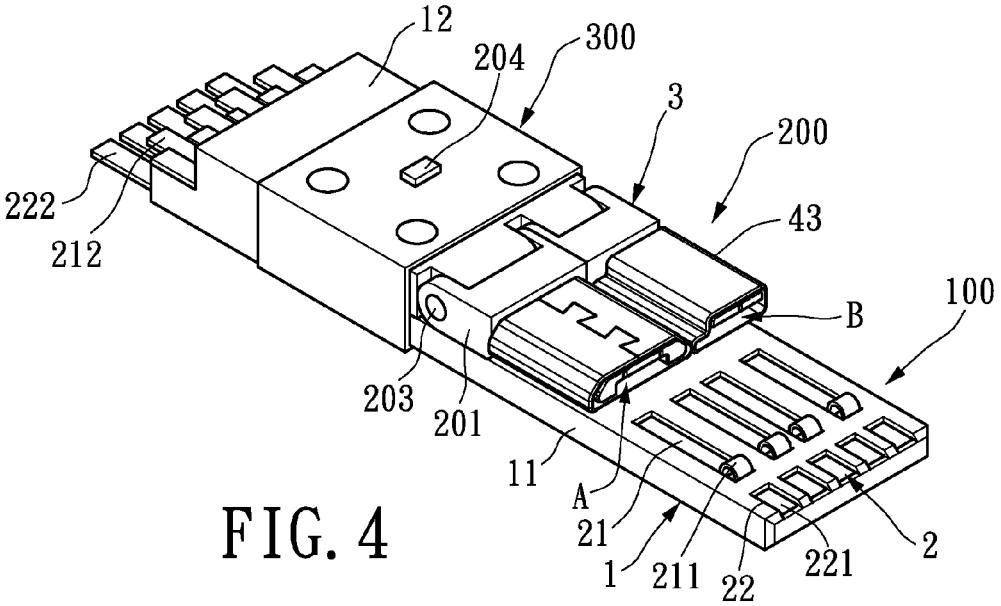
FIG. 4 illustrates a perspective view of a USB connector in accordance with a first embodiment of the instant disclosure.

On the contrary, when the second module 200 moves backwards toward the first mounting terminals 412 (as shown in FIG. 4), the first and second conductive portions 412, 422 are separated from the first and second contact portions 211, 221. As a result, the second conductive module 4 and the first conductive module 2 are electrically disconnected. That is to say the second conductive module 4 is not electrically connected to the cables or circuits via the first conductive module 2 and thus the second module 200 is not live. As the second module 4 moves backward, the front end of the first module 100 is exposed thereby. In other words, the sliding of the second module 4 leads to the exposure of the first and second contact portions 211, 221 of the conductive terminals 21, 22. Hence the first module 100 is available to receive other electronic device. In short, by adjusting the linear position of the second module 200, the retractable USB connector is switched under two different modules and USB standards (first module 100 and second module 200).

Figure 7:
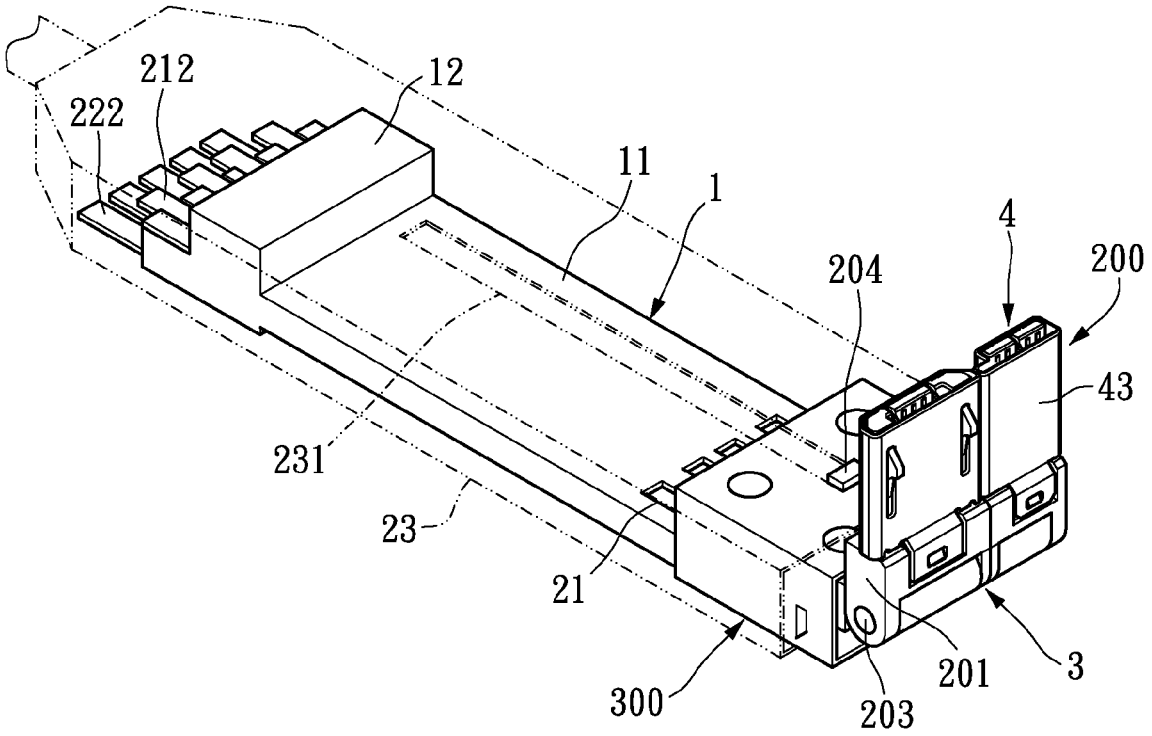
FIG. 7 illustrates a schematic diagram of a USB connector in use in accordance with a second embodiment of the instant disclosure.

The front end of the second module 200 can be rotatable as well. More specifically, the second module 200 is split into a front section and a rear section 201, 202. The front section 201 refers to the region from the third and fourth contact portions 411, 421 to a shaft assembly 203, while the rear section 202 refers to the region from the shaft assembly 203 to the end of the first and second conductive portions 412, 422. The shaft assembly 203 allows upward rotation of the front section 201 (as shown in FIG. 7). In more detail, to allow free rotation, the circuits between the front and rear sections 201, 202 are split into two parts (not shown) and re-connect by wires, conductive plates or soft circuits.

In the first embodiment, the second module 200 is secured within a sleeve 300, which can be a metallic shell. The second module 200 engages to the plate 11 of the first insulating main body 1 by the sleeve 300 which envelopes both the plate 11 and the second module 200. The sleeve 300 allows the second module 200 to move forward and backward along the plate 11. When the second module 200 moves toward the first and second mounting portions 212, 222, the second module 200 and the sleeve 300 abut against the bump 12 therefore not moving any further backward (as shown in FIG. 4). The second module 200 can be positioned at different spots along the plate 11 at by bumps, detents and the like. The engagement between the first and second modules 100, 200 is not restricted to the sleeve 300. For example, the second module 200 can engage with the first module 100 by tracks or detents.

Figure 6:
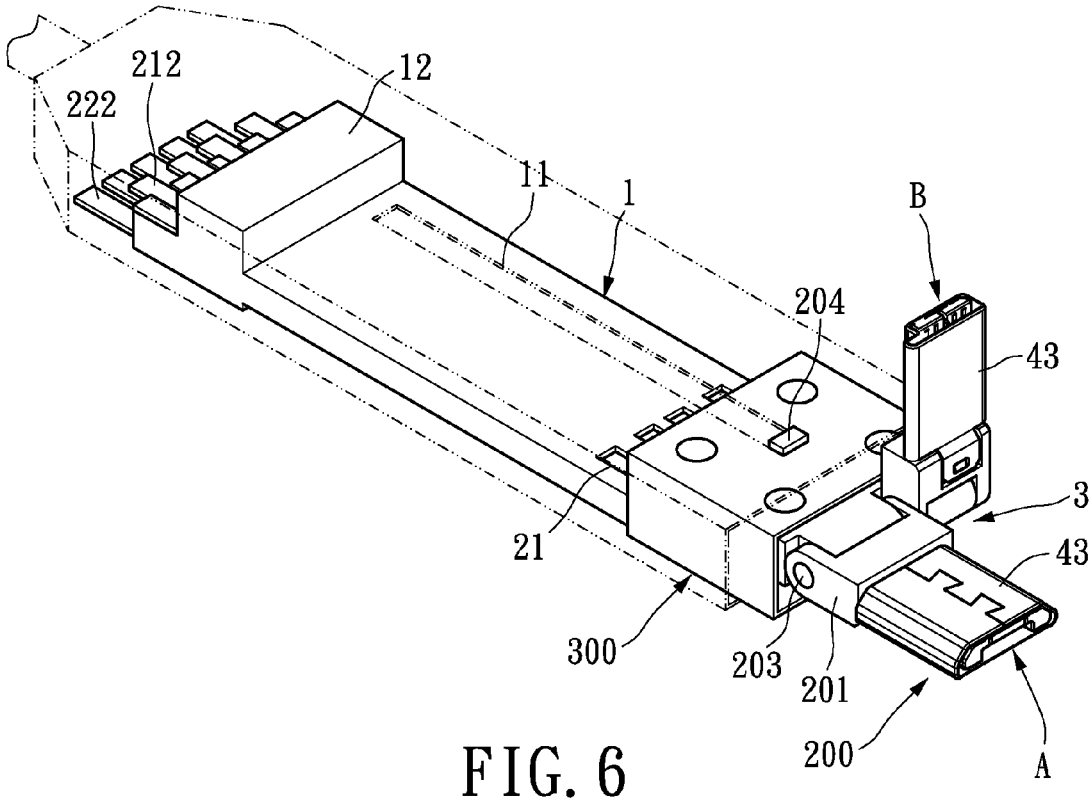
FIG. 6 illustrates another schematic diagram of a USB connector in use in accordance with a first embodiment of the instant disclosure.

Moreover, the front section 201 of the second insulating main body 3 can be split into two parts. That is to say the third and fourth conductive terminals are separated longitudinally as two portions so is the metallic shell 43. Therefore the second module 200 has two independent units, a first unit A and a second unit B. The first and second units A, B flips independently in order to satisfy different requirements. As shown in FIG. 6, the first unit A remains flat whereas the second unit B flips perpendicularly thereto. In contrast, as shown in FIG. 7, the first and second units A, B can be both bent upward.

The second module 200 may further include a slide button 204 which is disposed on the top or side face of the second insulating main body 3. In the first embodiment, the slide button 204 projects out from the top face of the second insulating main body 3 and the slide button 204 passes through a corresponding hole 301 formed on the sleeve 300. The slide button 204 facilitates linear sliding of the second module 200 along the plate 11.

[Second Embodiment]

With referent to FIG. 7, the instant embodiment differs with the first embodiment because the first insulating main body 1 and the first conductive module 2 are enveloped by a jacket 23. In use, as the second module 200 moves toward the second position, the closed jacket 23 prevents the second module 200 from flipping therein. In other words, the second module 200 can only be bent when the front section 201 completely moves out of the jacket 23. In the second embodiment the jacket 23 has a longitudinal slit 231 embedded in the inner wall thereof to conformingly receive the slide button 204 and allow the sliding of the second module 200.

[Third Embodiment]

Figure 8:
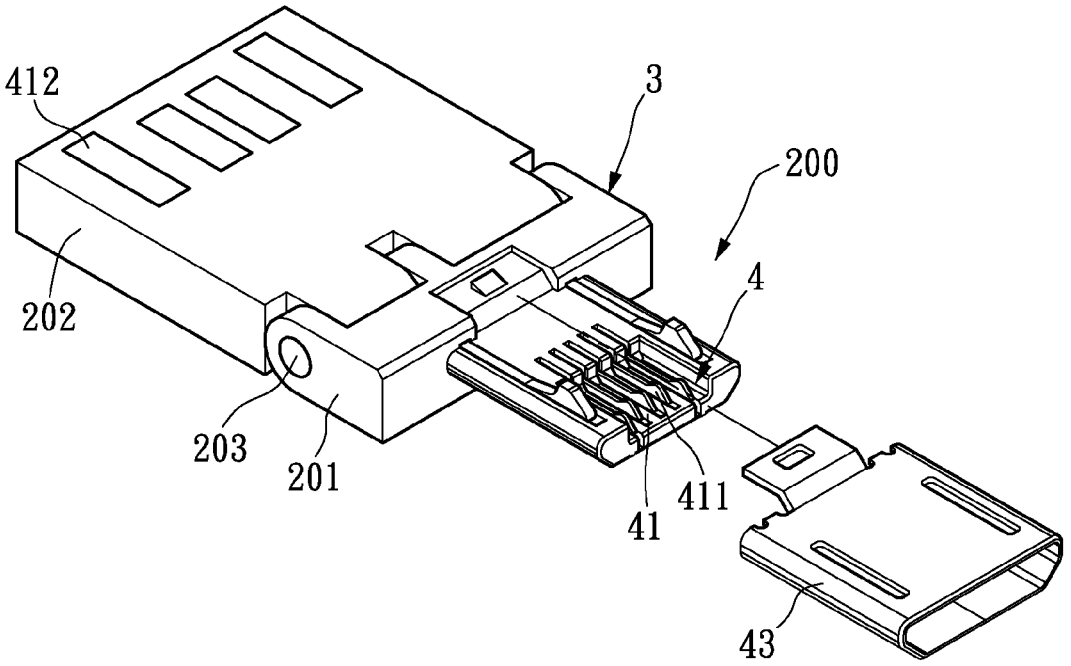
FIG. 8 illustrates an exploded view of a second module of a USB connector in accordance with a third embodiment of the instant disclosure.
Figure 9:
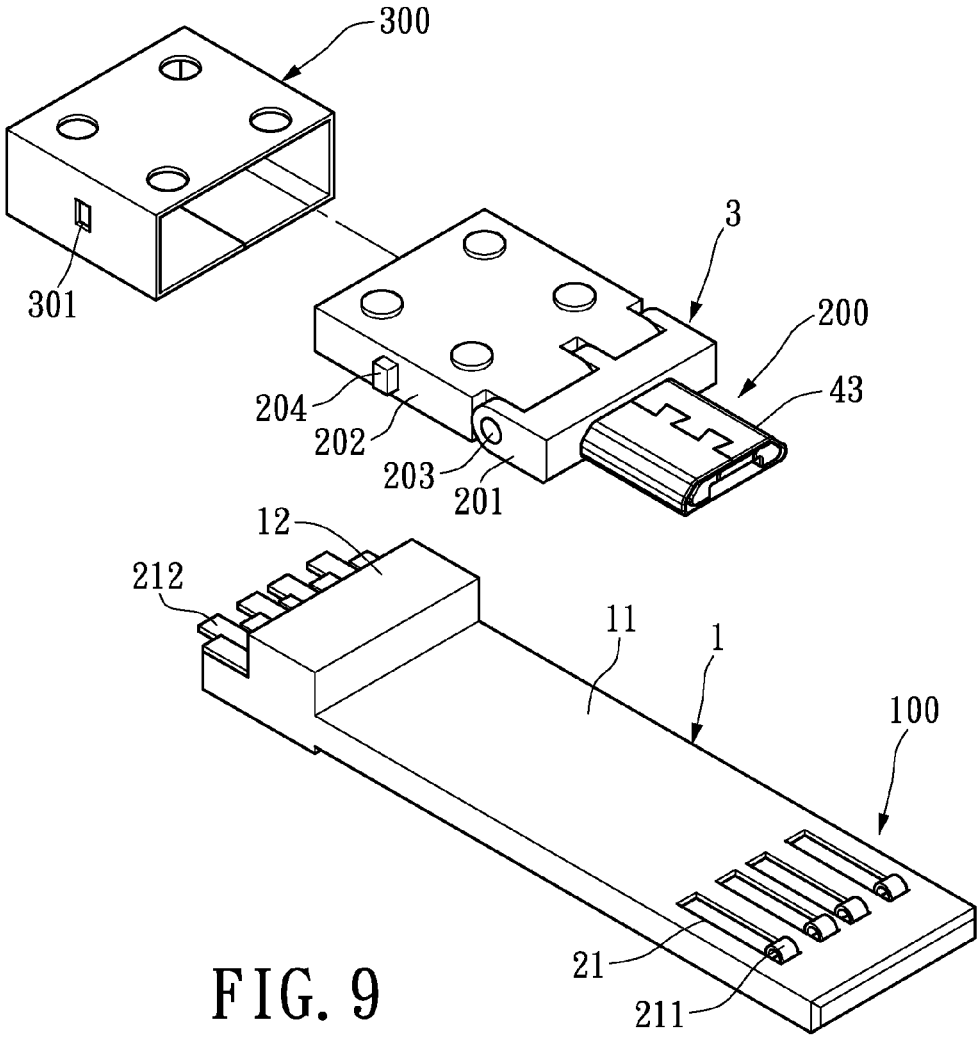
FIG. 9 illustrates an exploded view of a USB connector in accordance with a third embodiment of the instant disclosure.
Figure 10:
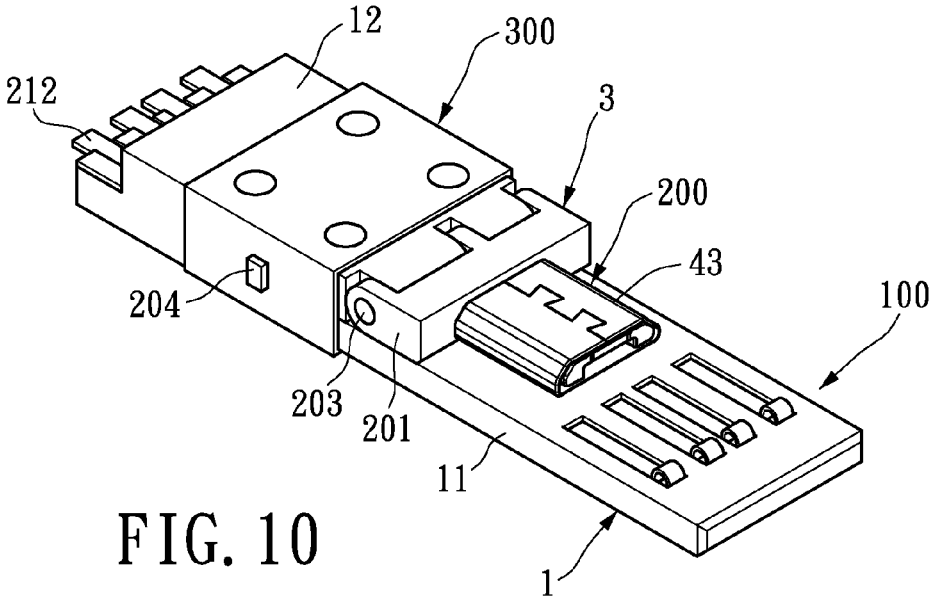
FIG. 10 illustrates a perspective view of a USB connector in accordance with a third embodiment of the instant disclosure.

With reference to FIGS. 8~10 the third embodiment differs from the previously mentioned embodiments because the first conductive module 2 includes only the plurality of first conductive terminals 21 and the second conductive module 4 includes the plurality of third conductive terminals 41 alone. Hence in the third embodiment the first module 100 meets the USB 2.0 A standard and the second module 200 meets the Micro USB (USB 2.0 Micro B) standard. The first conductive terminals 21 are formed with the first contact portion 211 and the first mounting portion 212. Likewise, the third conductive terminals 41 are formed with the third contact portion 411 and the first conductive portion 412. The second module 200 is still movable along the plate 11. When the second module 200 moves toward the first contact portion 211, the electrical connection can be established between the first conductive portion 412 and the corresponding first contact portion 211. When the second module 200 moves toward the first mounting terminals 212, the first conductive portion 412 and the first contact portion 211 are separated so the electrical connection is broken. In the third embodiment, with reference to FIG. 9 the slide button 204 is disposed on the side face of the second insulating main body 3 and budding out from the corresponding hole 31 of the sleeve 300.

[Fourth Embodiment]

Figure 11:
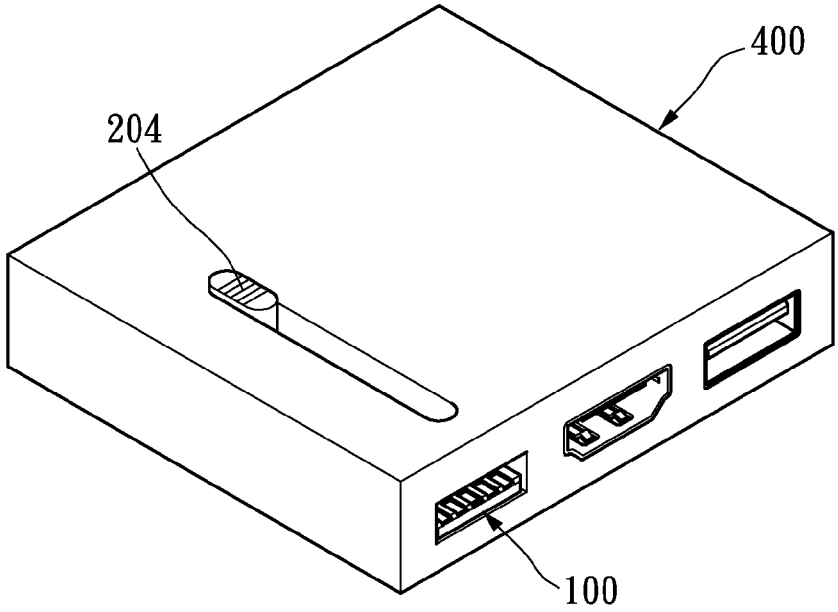
FIG. 11 illustrates a schematic diagram of a USB connector in accordance with a fourth embodiment of the instant disclosure.

With reference to FIG. 11 the fourth embodiment shows that the USB connector connects to a USB hub device 400 and electrically connects the circuits therein. The slide button 204 is disposed and exposed to allow movement of the second module 200.

[Fifth Embodiment]

Figure 12:
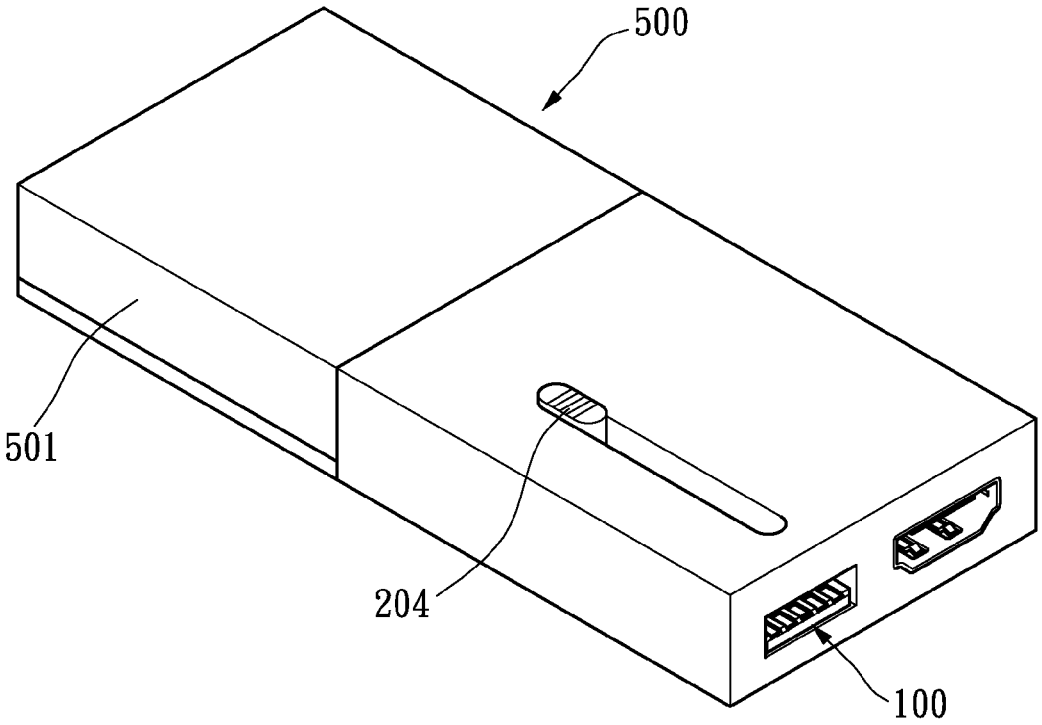
FIG. 12 illustrates a schematic diagram of a USB connector in accordance with a fifth embodiment of the instant disclosure.

With reference to FIG. 12 of the instant embodiment, the USB connector connects a power supply 500. The power supply 500 includes a power module 501 preferably being a rechargeable battery. The slide button 204 is still present on the second module 200 to facilitate liner movement thereof.

[Sixth Embodiment]

Figure 13:
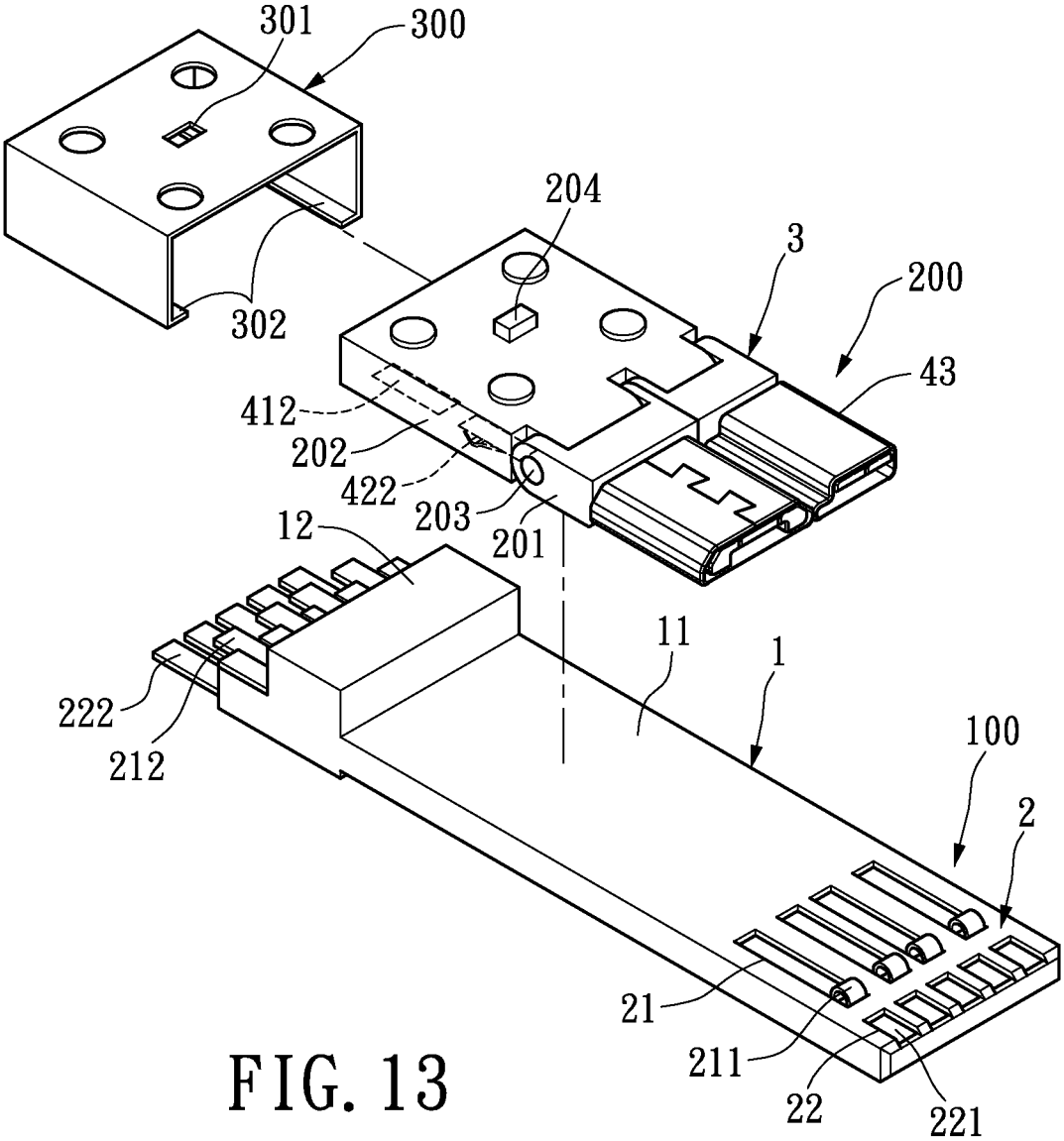
FIG. 13 illustrates an exploded view of a USB connector in accordance with a sixth embodiment of the instant disclosure.

With reference to FIG. 13 of the sixth embodiment, the second module 200 is secured within the sleeve 300 which is in the shape of "U". More specifically, one face of the sleeve 300 is removed and replaced by two thin flanges 302. As the sleeve 300 engages with the second module 200, the sleeve 300 along with the second module 200 then hooks onto the plate 11 from the bottom so the second module 200 is engaged with the plate 11 and free to slide.

[Seventh Embodiment]

Figure 14:
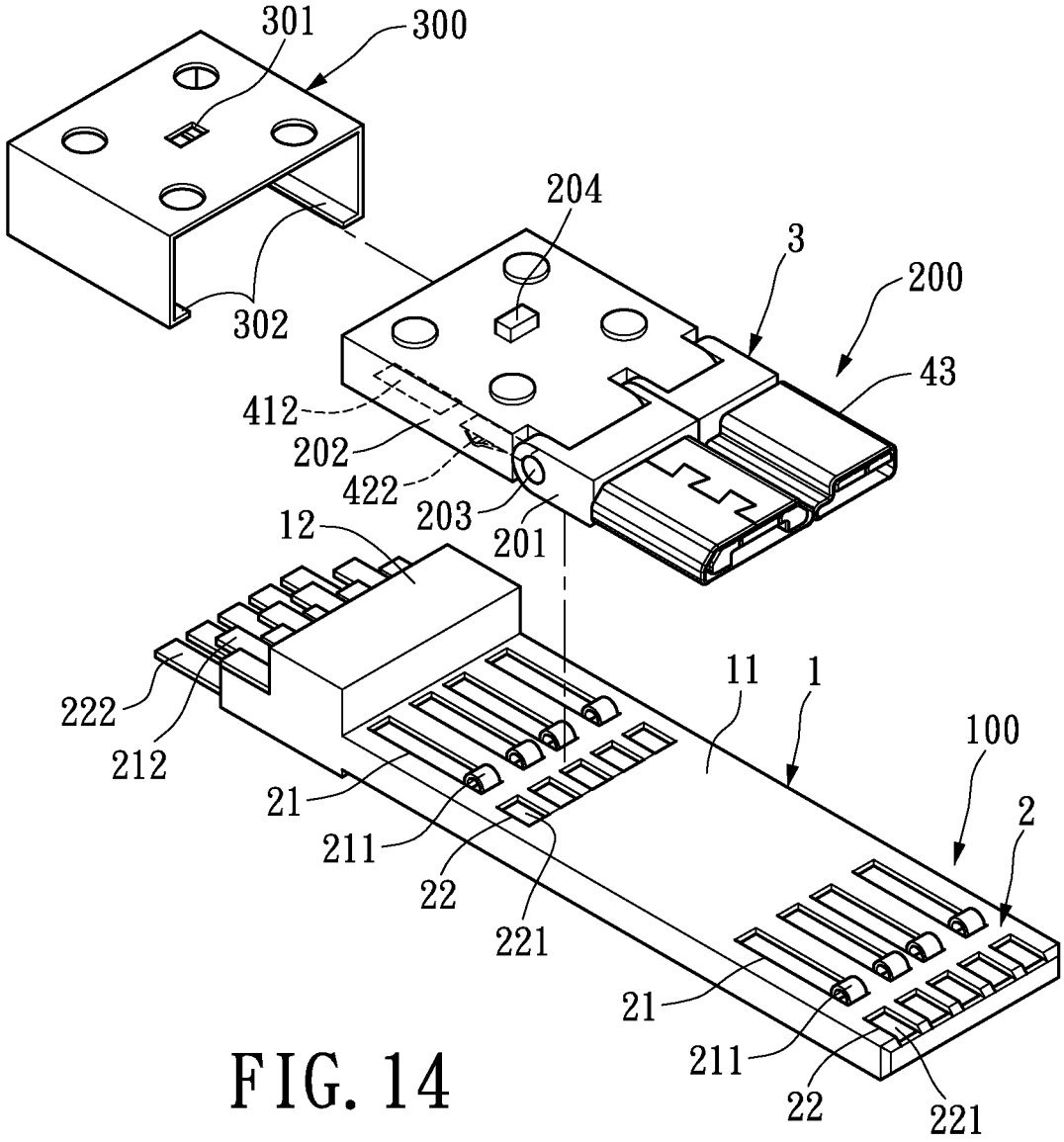
FIG. 14 illustrates an exploded view of a USB connector in accordance with a seventh embodiment of the instant disclosure.

With reference to FIG. 14 of the seventh embodiment, in addition to the existing pair of first and second conductive terminals 21, 22, an extra pair of the first and second conductive terminals is arranged at the rear end of the plate 11 (proximate to the bump 12). In use, once the first and second conductive portions 412, 422 of the second module 200 contact any pair of the corresponding first and second contact portions 211, 221 of the first module the second and first conductive modules 4, 2 are electrically connected.

[Eighth Embodiment]

Figure 15:
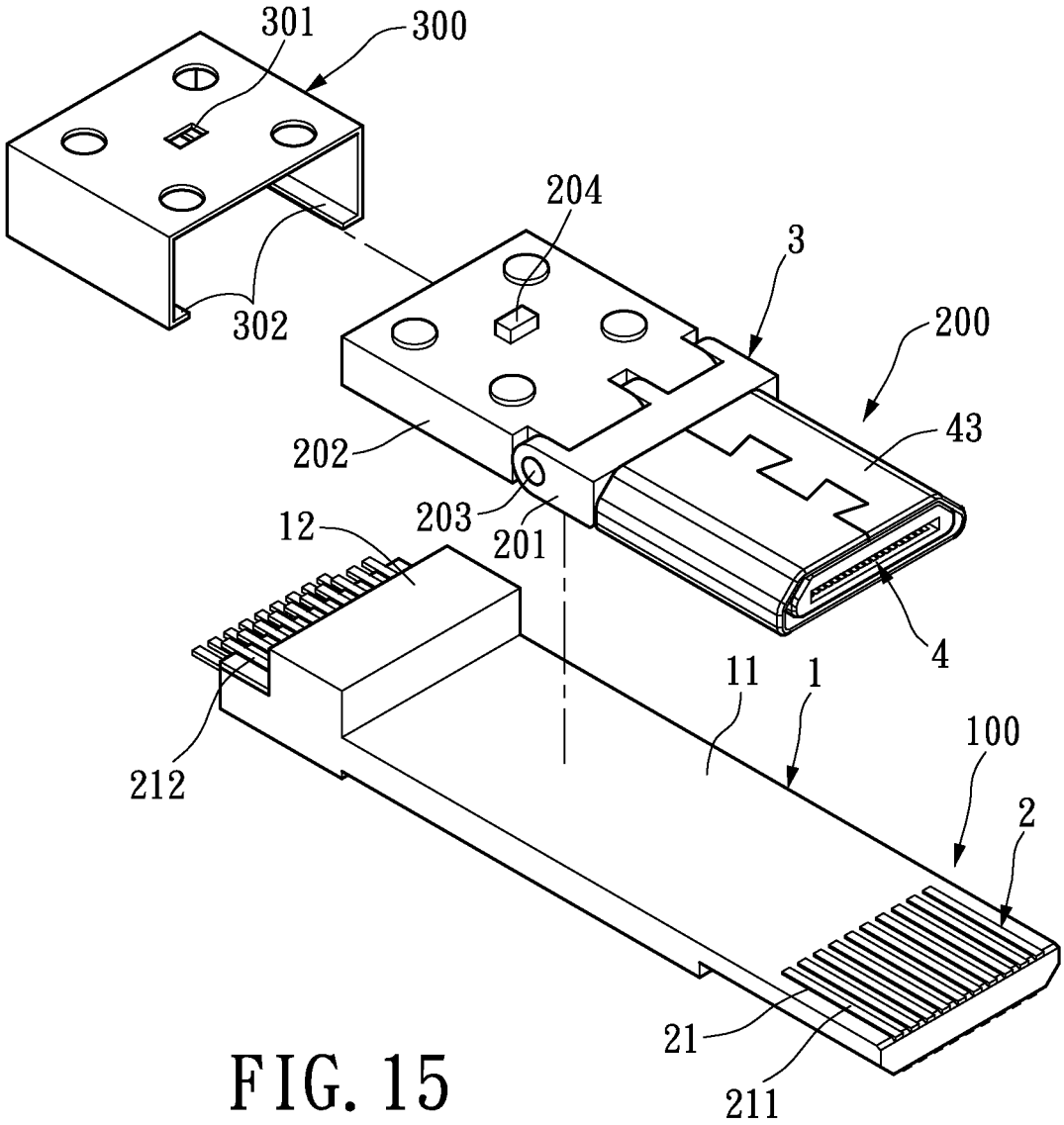
FIG. 15 illustrates an exploded view of a connector in accordance with an eighth embodiment of the instant disclosure.

With reference to FIG. 15 of the eighth embodiment, a retractable connector is disclosed. The first and second modules 100, 200 are compatible to more than USB standards. In other words, the first and second modules 100, 200 can meet High Definition Multimedia Interface (HDMI) and the like instead. For example, HDMI A, HDMI B, HDMI C HDMI D and HDMI E. In the instant embodiment, the first module 100 is a HDMI A receptacle whereas the second module 200 is a HDMI C plug. The first module 100 includes a first insulating main body 1 and a first conductive module 2. The second module 200 includes a second insulating main body 3 and a second conductive module 4. More specifically the first insulating main body 1 and the first conductive module 2 satisfy the HDMI A standard and the second insulating main body 3 and the second conductive module 4 meet the HDMI C standard. The remaining features are substantially identical to the aforementioned embodiments.

[Ninth Embodiment]

Figure 16:
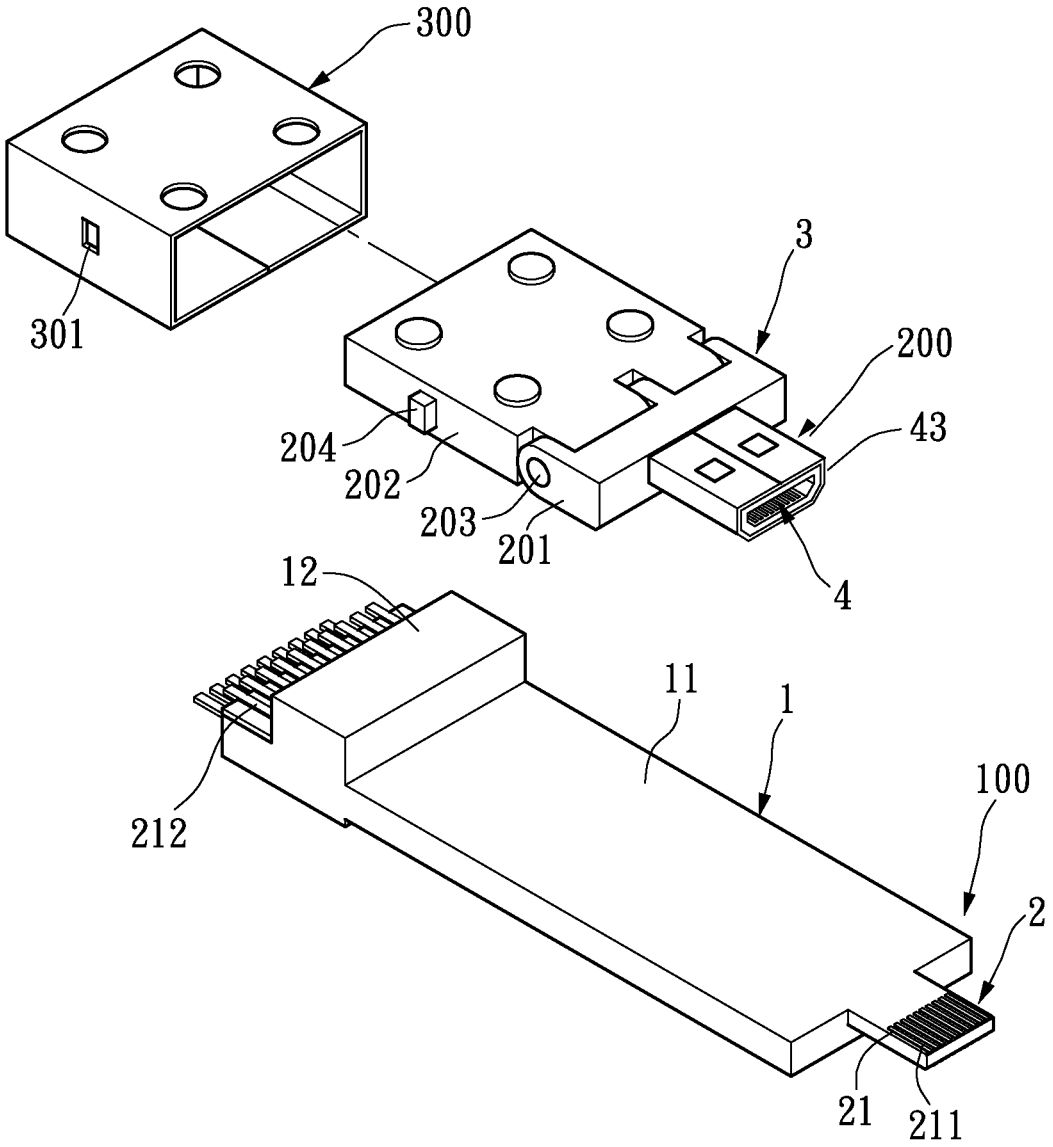
FIG. 16 illustrates an exploded view of a connector in accordance with a ninth embodiment of the instant disclosure.

With reference to FIG. 16 of the ninth embodiment, a retractable connector is disclosed. The first and second modules 100, 200 are adaptable for the HDMI and Mini DisplayPort (MiniDP) standards respectively. In the ninth embodiment, a first module 100 is a Mini DisplayPort receptacle, while the second module 200 is a HDMI D plug. The first module 100 includes a first insulating main body 1 and a first conductive module 2. The second module 200 includes a second insulating main body 3 and a second conductive module 4. In more detail, the first insulating main body 1 and the first conductive module 2 meet the specification of Mini DisplayPort. The second insulating main body 3 and the second conductive module 4 meet the HDMI D standard. The remaining structural features are substantially identical to the aforementioned embodiments.

[Tenth and Eleventh Embodiment]

Figure 17:
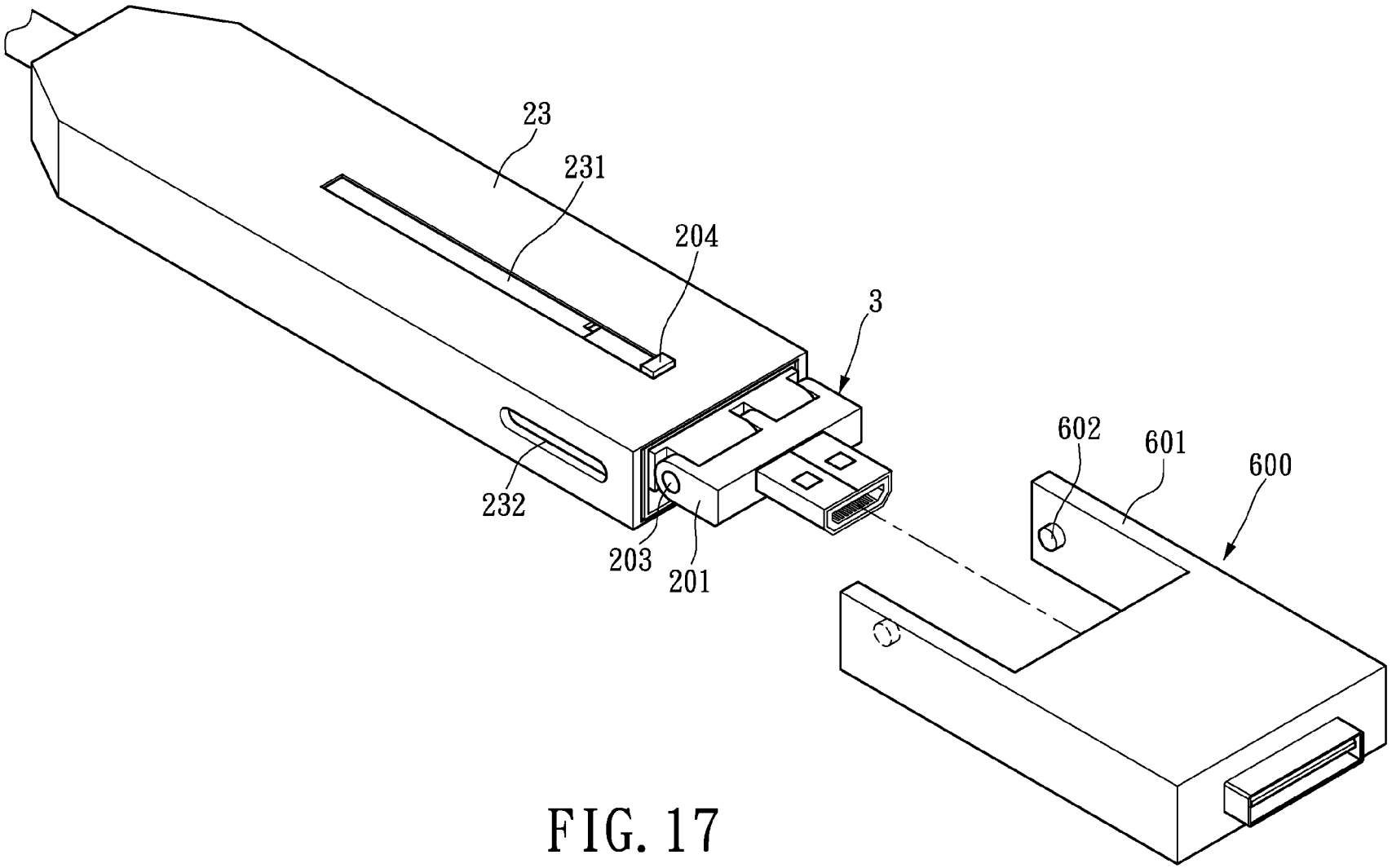
FIG. 17 illustrates a schematic diagram of a USB connector in accordance with a tenth embodiment of the instant disclosure.
Figure 18:
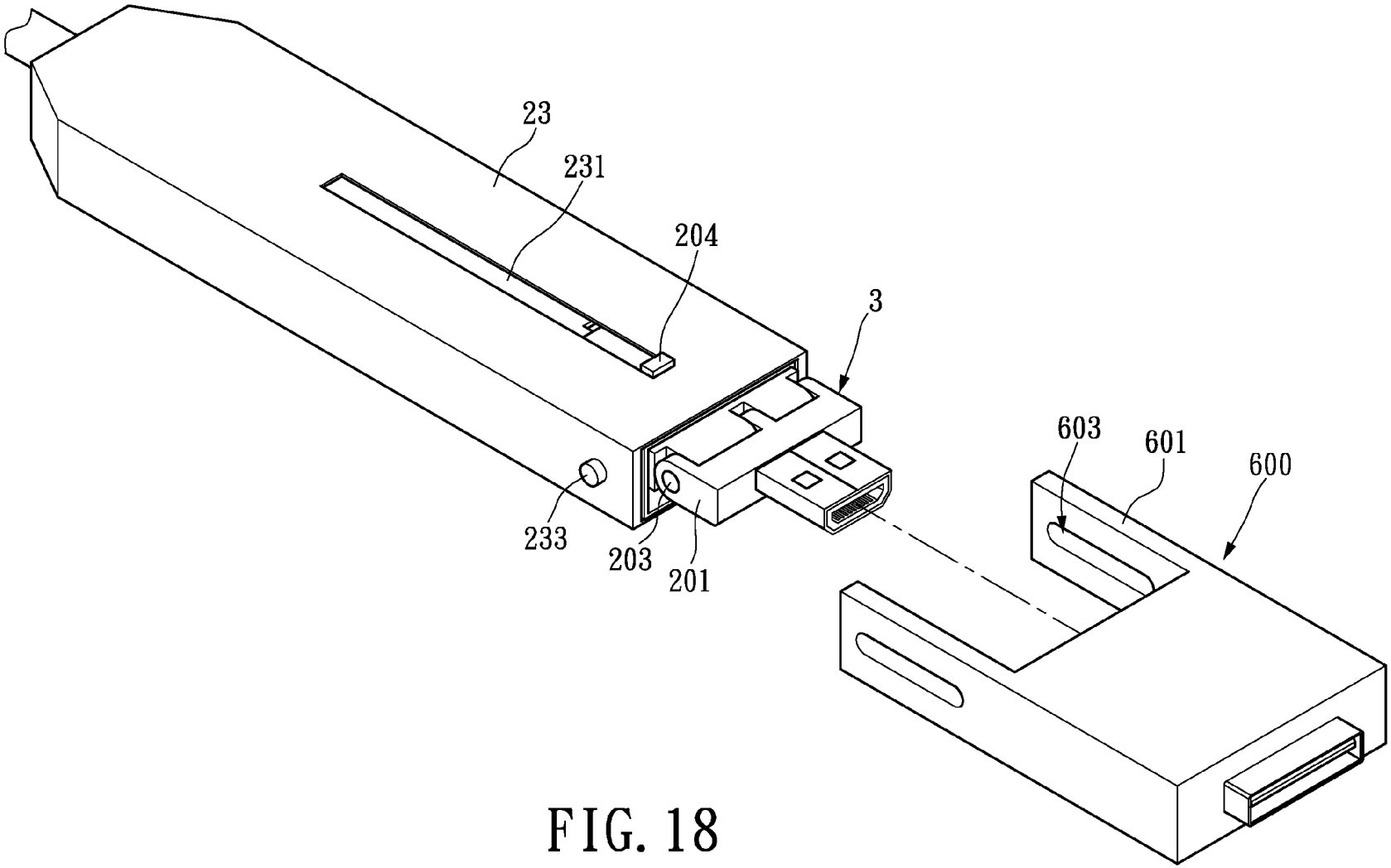
FIG. 18 illustrates a schematic diagram of a USB connector in accordance with an eleventh embodiment of the instant disclosure.

With reference to FIG. 17 of the tenth embodiment, the connector includes a pair of tracks 232 on the opposite side of the jacket 23 to allow a convertor 600 to slide in. The convertor 600 has a pair of knobs 602 disposed on two arms 601 and conforming to the pair of tracks 232 for sliding. With reference to FIG. 18 of the eleventh embodiment, the connector includes a pair of knobs 233 on the opposite side thereof while the convertor 600 is formed with a corresponding pair of tracks 603 for receiving the knobs 233 respectively. When the connector completely engages with the convertor 600, electrical connection is established there-between as well. The slidable and rotatable convertor 600 increases the variety of electronic devices which can be used on the connector.

[Twelfth Embodiment]

Figure 19:
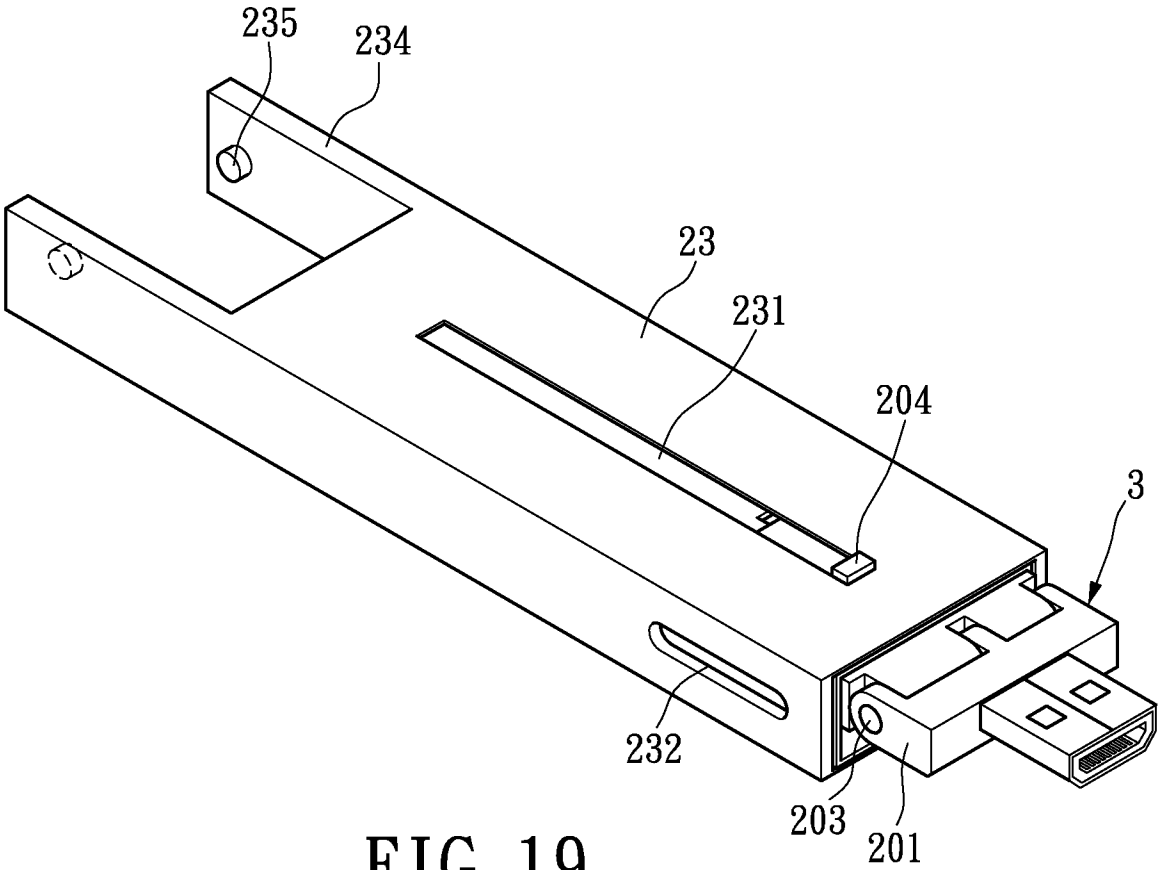
FIG. 19 illustrates a schematic diagram of a USB connector in accordance with a twelfth embodiment of the instant disclosure.

With reference to FIG. 19 of the twelfth embodiment, a pair of arms 234 extends from the rear end of the jacket 23 and has a pair of knobs 235 thereon. The arms 234 along with the knobs 235 allow further connection with another device.

In summary, the instant disclosure provides the retractable connector so the second module 200 is linearly movable along the first module 100 for different connector requirements. The second module 200 may further be split into two independent portions as first unit A and second unit B and flipping accordingly. Furthermore, the retractable connector is capable to be extended and converted to adapt different electronic standards.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A retractable Universal Serial Bus (USB) connector comprising:

a first module including:

a first insulating main body; and a first conductive module disposed in the first insulating main body and having a plurality of first conductive terminals and a plurality of second conductive terminals, each of the first conductive terminals formed with a separated pair of first contact portions and a separated pair of first mounting portions disposed on the opposite end of the first insulating main body, each of the second conductive terminals formed with a separated pair of second contact portions and a separated pair of second mounting portions disposed on the opposite end of the first insulating main body; and a second module disposed on the first module including:

a second insulating main body; and a second conductive module disposed in the second insulating main body and having a plurality of third conductive terminals and a plurality of fourth conductive terminals, each of the third conductive terminals formed with a third contact portion and a first conductive portion, and each of the fourth conductive terminals formed with a fourth contact portion and a second conductive portion;

wherein the second module is divided into a front section and a rear section by a shaft assembly, and the front section is approximately from the third and fourth contact potions to the shaft assembly whereas the rear section is approximately from the shaft assembly to the second conductive portion;

wherein the second module is linearly movable on the first module and configured to allow electrical connection with the corresponding first and second contact portions when the second module contacts thereto.

2. A retractable Universal Serial Bus (USB) connector comprising:

a first module including:

a first insulating main body; and a first conductive module disposed in the first insulating main body and having a plurality of first conductive terminals, each of the first conductive terminals formed with a first contact portion and a first mounting portion; and a second module disposed on the first module including:

a second insulating main body; and a second conductive module disposed in the second insulating main body and having a plurality of third conductive terminals, each of the third conductive terminals formed with a third contact portion and a first conductive portion;

wherein the second module is divided into a front section and a rear section by a shaft assembly, and the front section is approximately from the third contact potion to the shaft assembly whereas the rear section is approximately from the shaft assembly to the first conductive portion;

wherein the second module is linearly movable on the first module and configured to allow electrical connection with the corresponding first and second contact portions when the second module contacts thereto, and allow electrical disconnection from the corresponding first and second contact portions when the second module is removed there-from.

3. The retractable USB connector according to claim 2, wherein the first module meets a HDMI standard or a Mini DisplayPort standard.

4. The retractable USB connector according to claim 2, wherein the second module meets a HDMI standard or a Mini DisplayPort standard.

5. A retractable Universal Serial Bus (USB) connector comprising:

a first module including:

a first insulating main body; and a first conductive module disposed in the first insulating main body and having a plurality of first conductive terminals and a plurality of second conductive terminals, each of the first conductive terminals formed with a first contact portion and a first mounting portion, each of the second conductive terminals formed with a second contact portion and a second mounting portion; and a second module disposed on the first module including:

a second insulating main body; and a second conductive module disposed in the second insulating main body and having a plurality of third conductive terminals and a plurality of fourth conductive terminals, each of the third conductive terminals formed with a third contact portion and a first conductive portion, each of the fourth conductive terminals formed with a fourth contact portion and a second conductive portion;

wherein the second module is divided into a front section and a rear section by a shaft assembly, and the front section is approximately from the third and fourth contact potions to the shaft assembly whereas the rear section is approximately from the shaft assembly to the second conductive portion;

wherein the second module is linearly movable on the first module and configured to allow electrical connection with the corresponding first and second contact portions when the second module contacts thereto, and allow electrical disconnection from the corresponding first and second contact portions when the second module is removed there-from.

6. The retractable USB connector according to claim 5, wherein the first module meets a USB specification selected from a group consisting of: USB A, USB B, Micro USB and Mini USB standard.

7. The retractable USB connector according to claim 5, wherein the second module meets a USB specification selected from a group consisting of: USB A, USB B, Micro USB and Mini USB standard.

8. The retractable USB connector according to claim 5, wherein the first insulating main body has a plate and a bump formed on the rear end of the plate, the first and second contact portions are exposed from the front end of the plate, and the second module is disposed on the plate in a linearly movable manner.

9. The retractable USB connector according to claim 5, wherein the front section of the second module is longitudinally split into two portions of a first unit and a second unit thereby the third and fourth conductive terminals are allowed for independent movement.

10. The retractable USB connector according to claim 5 selectively connecting a power supply and a USB hub device.

11. The retractable USB connector according to claim 5 further formed with a pair of tracks for receiving a pair of knobs disposed on a convertor and the tracks and knobs are interchangeable between the retractable USB connector and the convertor.

12. The retractable USB connector according to claim 5, wherein the second module includes a slide button.

13. The retractable USB connector according to claim 12, wherein the first module is enveloped by a jacket, and the jacket has a slit for receiving the slide button.

14. A retractable Universal Serial Bus (USB) connector comprising:

a first module including:

a first insulating main body; and a first conductive module disposed in the first insulating main body and having a plurality of first conductive terminals, each of the first conductive terminals formed with a first contact portion and a first mounting portion; and a second module disposed on the first module including:

a second insulating main body; and a second conductive module disposed in the second insulating main body and having a plurality of third conductive terminals, each of the third conductive terminals formed with a third contact portion and a first conductive portion;

wherein the second module is divided into a front section and a rear section by a shaft assembly, and the front section is approximately from the third contact potion to the shaft assembly whereas the rear section is approximately from the shaft assembly to the first conductive portion;

wherein the second module is linearly movable on the first module and configured to allow electrical connection with the corresponding first contact portion when the second module contacts thereto, and allow electrical disconnection from the corresponding first contact portions when the second module is removed there-from.

15. The retractable USB connector according to claim 14, wherein the first module meets a USB specification selected from a group consisting of: USB A, USB B, Micro USB and Mini USB standard.

16. The retractable USB connector according to claim 14, wherein the second module meets a USB specification selected from a group consisting of: USB A, USB B, Micro USB and Mini USB standard.

17. The retractable USB connector according to claim 14, wherein the first insulating main body has a plate and a bump formed on the rear end of the plate, the first and second contact portions are exposed from the front end of the plate, and the second module is disposed on the plate in a linearly movable manner.

18. The retractable USB connector according to claim 14 selectively connecting a power supply and a USB hub device.

19. The retractable USB connector according to claim 14 further formed with a pair of tracks for receiving a pair of knobs disposed on a convertor, and the tracks and knobs are interchangeable between the retractable USB connector and the convertor.

20. The retractable USB connector according to claim 14, wherein the second module includes a slide button.

21. The retractable USB connector according to claim 20, wherein the first module is enveloped by a jacket, and the jacket has a slit for receiving the slide button.

* * * * *